US005402037A

United States Patent [19]

Irisawa et al.

[11] Patent Number: 5,402,037

[45] Date of Patent: Mar. 28, 1995

[54] ARC TUBE HAVING PARTICULAR VOLUME AND GAS PRESSURE FOR LUMINOUS FLUX

[75] Inventors: Shinichi Irisawa; Yasuyoshi Numajiri; Kunimasa Mochiduki, all of Shizuoka, Japan

[73] Assignee: Koito Manufacturing Co., Ltd., Tokyo, Japan

[21] Appl. No.: 29,231

[22] Filed: Mar. 9, 1993

[30] Foreign Application Priority Data

Mar. 17, 1992 [JP] Japan ..... 4-060577

[51] Int. Cl.[6] ..... H01J 17/20

[52] U.S. Cl. ..... 313/570; 313/571; 313/637; 313/639; 313/642

[58] Field of Search ..... 313/570, 25, 642, 571, 313/572, 573, 637, 638, 639; 445/26

[56] References Cited

U.S. PATENT DOCUMENTS

| | | | |
|---|---|---|---|
| 4,247,798 | 1/1981 | Howe et al. | 313/225 |
| 5,126,619 | 1/1992 | Wakimizu et al. | 313/25 |
| 5,250,872 | 10/1993 | Wakimizu et al. | 313/25 |
| 5,277,639 | 1/1994 | Nagata et al. | 445/26 |

FOREIGN PATENT DOCUMENTS

| | | |
|---|---|---|
| 3904926 | 8/1989 | Germany . |
| 3904927 | 8/1989 | Germany . |
| 2216334 | 10/1989 | United Kingdom . |

OTHER PUBLICATIONS

Lamps and Lighting, Third Edition by Marsden 1933 pp. 210–223.

*Primary Examiner*—Sandra L. O'Shea
*Assistant Examiner*—Ali Horri
*Attorney, Agent, or Firm*—Sughrue, Mion, Zinn, Macpeak & Seas

[57] ABSTRACT

An arc tube for a discharge lamp unit which emits light which is suitable in luminous flux, color temperature, and chromaticity. The arc tube is composed of a closed glass ball in which electrodes confront one another and which is sealingly charged with light emitting materials, namely, mercury and a metal iodide of NaI and $ScI_3$ groups together with Xe inert gas. In accordance with the invention, the closed glass ball has a volume of 20 to 50 μl, the density of the mercury in the closed glass ball is in a range of $2\times10^{-2}$ to $4\times10^{-2}$ mg/μl, the density of the metal iodide is in a range of $6\times10^{-3}$ to $12\times10^{-3}$ mg/μl, and the charged Xe gas pressure is 3 to 6 atm. These ranges make it possible to readily manufacture on a large scale arc tubes which are substantially equal in performance, being substantially uniform in tube voltage, luminous flux, color temperature and chromaticity.

1 Claim, 8 Drawing Sheets

SPECTRAL DISTRIBUTION OF LIGHT WHEN METAL IODIDE IS VARIED IN DENSITY

SPECTRAL DISTRIBUTION OF LIGHT WHEN MERCURY DENSITY AND CHARGED GAS PRESSURE ARE VARIED

FIG. 10

METAL IODIDE DENSITY VARIATION

| | |
|---|---|
| DENSITY OF IODIDE | SMALL ← → LARGE |
| LUMINOUS FLUX | SMALL ← → LARGE |
| COLOR TEMPERATURE | HIGH ← → LOW |
| CHROMATICITY X | SMALL ← → LARGE |
| CHROMATICITY Y | SMALL ← → LARGE |
| TUBE VOLTAGE | LOW ← → HIGH |

FIG. 11

MERCURY DENSITY VARIATION

| | |
|---|---|
| DENSITY OF MERCURY | SMALL ← → LARGE |
| LUMINOUS FLUX | LARGE ← → SMALL |
| COLOR TEMPERATURE | LOW ← → HIGH |
| CHROMATICITY X | LARGE ← → SMALL |
| CHROMATICITY Y | LARGE ← → SMALL |
| TUBE VOLTAGE | LOW ← → HIGH |

FIG. 12

Xe GAS PRESSURE VARIATION

| | |
|---|---|
| PRESSURE | SMALL ← → LARGE |
| LUMINOUS FLUX | SMALL ← → LARGE |
| COLOR TEMPERATURE | HIGH ← → LOW |
| CHROMATICITY X | SMALL ← → LARGE |
| CHROMATICITY Y | SMALL ← → LARGE |
| TUBE VOLTAGE | LOW ← → HIGH |

ARC TUBE HAVING PARTICULAR VOLUME AND GAS PRESSURE FOR LUMINOUS FLUX

BACKGROUND OF THE INVENTION

The present invention relates to an arc tube for a discharge lamp unit of a type which has recently seen increasing use as a bulb for a vehicular headlamp due to its excellent luminous efficiency, color rendering characteristics and long service life compared with an incandescent bulb.

A discharge lamp unit is constructed as shown in FIG. 13. An arc tube 4 is supported by a pair of metal lead supports 2 and 3 which extend from an insulating base 1. The arc tube 4 has a closed glass ball 4a at the middle and pinch-sealed portions **4*b* on both sides of the closed glass ball 4*a* formed by pinch-sealing the two open end portions of a quartz glass tube. The closed glass ball 4*a* defines a discharge section. An electrode assembly 5, composed of a tungsten electrode 5*a*, a molybdenum foil 5*b* and a molybdenum lead wire 5*c*, is sealingly held in each of the pinch-sealed portions 4*b* in such a manner that the electrodes 5*a* protrude into the closed glass ball 4*a* and the lead wires 5*c* extend outwardly from the pinch-sealed portions 4*b*. The lead wires 5*c* are welded to respective ones of the lead supports 2 and 3, which are arc tube supporting members and serve as current supplying lines for the lead wires 5*c*. Light emitting materials, i.e., mercury and metal iodide together with an inert gas (Xe) are sealingly filled in the discharge section, i.e., in the closed glass ball 4*a* of the arc tube 4**.

In order to light the arc tube stably without extinction of the arc, increase of the firing (arc striking) voltage, or breakage of the arc tube, it is preferable that a voltage of 80 to 90 volts (tube voltage) be applied to the arc tube. To properly operate the arc tube, it is necessary that the output light of the arc tube be suitable in luminous flux, color temperature, and chromaticity. However, no standard ranges have heretofore been established for the quantities of mercury and metal iodide in the closed glass ball and the Xe gas pressure to obtain a suitable luminous flux, color temperature, and chromaticity.

SUMMARY OF THE INVENTION

The inventors have performed various experiments to determine how the luminous flux, color temperature and chromaticity of the output light of the arc tube change with the densities of mercury and metal iodide and the inert gas pressure, and as a result have accomplished the present invention.

A specific object of the invention is to solve the above-described problems accompanying a conventional arc tube for a discharge lamp unit. More specifically, an object of the invention is to provide an arc tube for a discharge lamp unit which outputs light suitable in luminous flux, color temperature, and chromaticity.

The foregoing and other objects of the invention have been achieved by the provision of an arc tube for a discharge lamp unit which has a closed glass ball in which electrodes confront one another and which is sealingly charged with light emitting materials, namely, mercury and a metal iodide of NaI and $ScI_3$ groups together with an inert gas, namely, Xe gas, in which, according to the invention, the volume of the closed glass ball is 20 to 50 μl, the density of the mercury in the closed glass ball is $2\times10^{-2}$ to $4\times10^{-2}$ mg/μl, the amount of metal iodide in the closed glass ball is $6\times10^{-3}$ to $12\times10^{-3}$ mg/μl, and the charged Xe gas pressure is 3 to 6 atm.

In the case where a discharge lamp unit is used as a light source for a vehicular lamp, the size of the discharge lamp unit is of course determined in accordance with the size of the lamp body. The size of the arc tube, which is the light source body, is accordingly determined. In the case of an arc tube for a discharge lamp unit, it is generally desirable that the volume of its closed glass ball, which forms the light emitting section of the arc tube, be in a range of 20 to 50 μl.

The tube voltage of the arc tube is preferably in a range of 80 to 90 V, as described above. The level of the output light from the arc tube so as to sufficiently illuminate the road ahead of the vehicle on which the headlamp is mounted but not dazzle the driver on an oncoming vehicle is determined follows: the luminous flux is in a range of 3,200 to 3,500 lumen, the chromaticity (x) is in a range of 0.38 to 0.39, the chromaticity (y) is in a range of 0.39 to 0.40, and the corresponding color temperature is in a range of 4,000° K. to 4,500° K. The luminous flux, color temperature, chromaticity (x), chromaticity (y) and tube voltage relate to the densities of the metal iodide and the mercury in the closed glass ball and the charged Xe gas pressure as shown in FIGS. 1 through 12.

In order to obtain the above-described desirable luminous flux, color temperature, chromaticity and tube voltage, the density of the mercury should be in a range of $2\times10^{-2}$ to $4\times10^{-2}$ mg/μl, the density of the metal iodide in a range of $6\times10^{-3}$ to $12\times10^{-3}$ mg/μl, and the charged Xe gas pressure in a range of 3 to 6 atm. That is, in the case where the density of the mercury is greater than $4\times10^{-2}$ mg/μl, the tube voltage exceeds 100 V, thus impairing the stability and durability of the arc. If the density of the mercury is lower than $2\times10^{-2}$ mg/μl, then the tube voltage will be lower than 80 , thus adversely affecting the continuity of lighting. When the density of the metal iodide is lower than $6\times10^{-3}$ mg/μl, the luminous flux will not reach 3,200 lumen; that is, the minimum desired luminance is not obtained. If, on the other hand, the density of the metal iodide is higher than $12\times10^{-3}$ mg/μl, excess, unvaporized iodide forms an iodide pool on the inner surface of the closed glass ball of the arc tube. The iodide pool thus formed may make the headlamp irregular in color and cause it to emit a glaring light beam. When the charged Xe gas pressure is less than 3 atm, then the color temperature is excessively high, i.e., on the order of 4,800° K. or greater. If it exceeds 6 atm, then the tube voltage becomes higher than 90 V, thus adversely affecting the stability and durability of the arc.

According to the invention, desirable standard ranges are established for the densities of the mercury and the metal iodide filled in the closed glass tube of the arc tube and for the charged Xe gas pressure. By setting the mercury density, the metal iodide density, and the charged Xe gas pressure in the standard ranges thus established, an arc tube can be obtained which emits a light beam under a suitable tube voltage which, being substantially constant in luminous flux, chromaticity and color temperature, illuminates the road ahead at a level so that it can be seen by the driver with ease but the beam will not dazzle the driver on a oncoming vehicle.

DESCRIPTION OF THE PREFERRED EMBODIMENTS

FIG. 10 is a diagram indicating how the luminous flux, color temperature, chromaticity (x), chromaticity (y) and tube voltage change with metal iodide density;

FIG. 11 is a diagram indicating how the luminous flux, color temperature, chromaticity (x), chromaticity (y) and tube voltage change with mercury density;

FIG. 12 is a diagram indicating how the luminous flux, color temperature, chromaticity (x), chromaticity (y) and tube voltage change with charged Xe gas pressure.

DESCRIPTION OF THE PREFERRED EMBODIMENTS

Preferred embodiments of the invention will be described with reference to the accompanying drawings.

Figure 13:
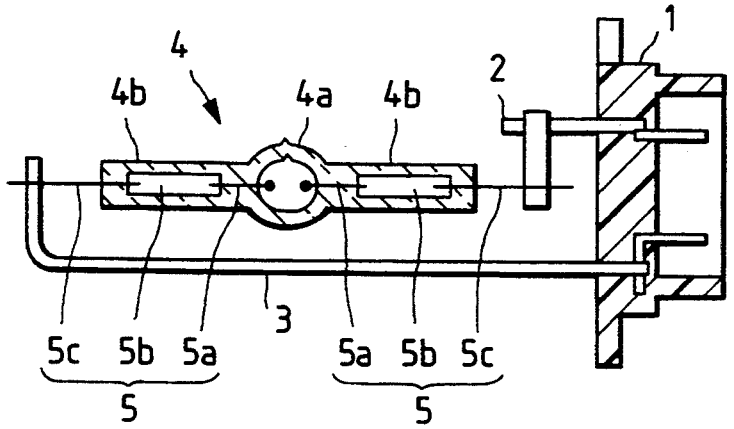
FIG. 13 PRIOR ART
FIG. 13 is an explanatory diagram showing the construction of a discharge lamp unit in a cross-sectional view.

An arc tube according to the invention has the same structure as the conventional arc tube shown in FIG. 13. However, it should be noted that the arc tube of the invention differs from the conventional arc tube in the densities of light emitting materials, namely, metal iodide (sodium iodide and scandium iodide) and mercury which, together with an inert gas, namely, Xe gas, are sealingly filled in the closed glass ball 4*a*, and in the pressure of the Xe gas (hereinafter referred to as "a charged Xe gas pressure", when applicable).

That is, in the closed glass ball 4*a* of the arc tube of the invention, the density of metal iodide is $6\times10^{-3}$ to $12\times10^{-3}$ mg/μl, the density of mercury is $2\times10^{-2}$ to $4\times10^{-2}$ mg/μl, and the charged Xe gas pressure is 3 to 6 atm. In this case, with a tube voltage of 80 to 90 V, the luminous flux of the output light is 3,200 to 3,500 lumen, the chromaticity (x) is 0.38 to 0.39, the chromaticity (y) is 0.39 to 0.40, and the color temperature is 4,000° to 4,500° K.

Figure 1:
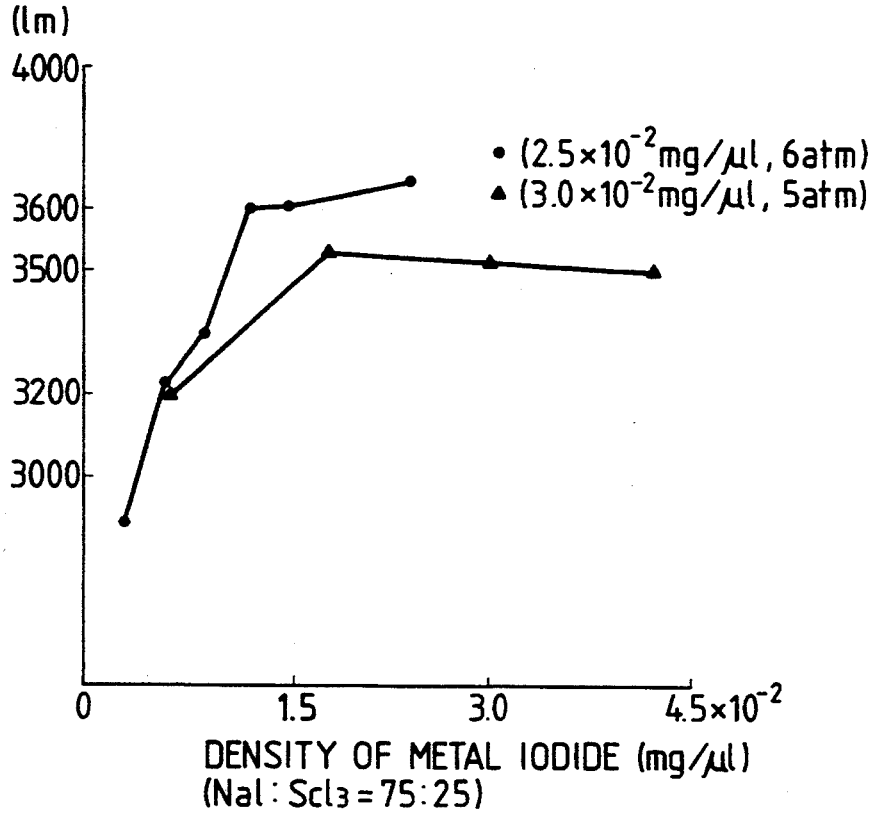
FIG. 1 is a graphical representation indicating relationships between the density (mg/μl) of metal iodide in a closed glass ball and luminous flux.

FIG. 1 is a graphical representation indicating the relationship between the density (mg/μl) of metal iodide in the closed glass ball and the luminous flux. As is apparent from FIG. 1, the luminous flux increases substantially with the quantity (density) of metal iodide in the closed glass ball. However, when the density exceeds about $1.5\times10^{-2}$ mg/μl, the rate of increase is decreased; that is, the luminous flux tends to decrease. It is also seen from FIG. 1 that, in order to obtain a desirable luminous flux (3,200 to 3,500 lumen), the density of metal iodide should be at least $6\times10^{-3}$ mg/μl.

Figure 2:
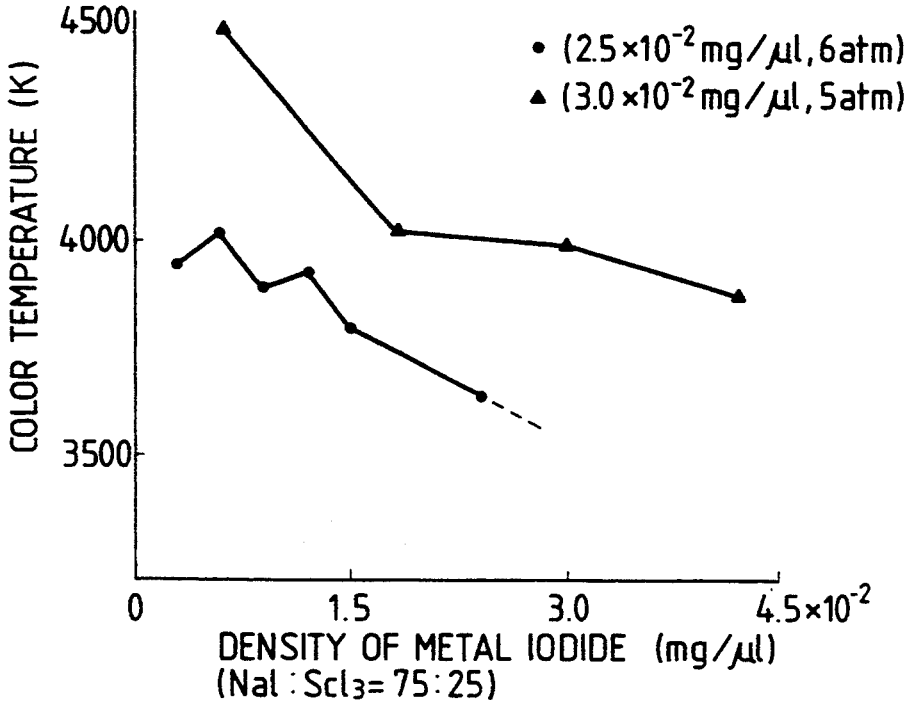
FIG. 2 is a graphical representation indicating relationships between the density of metal iodide in the closed glass ball and color temperature.

FIG. 2 is a graphical representation indicating the relationship between the density (mg/μl) of metal iodide in the closed glass ball and the color temperature. As is apparent from FIG. 2, the color temperature decreases as the quantity (density) of metal iodide increases. In the case where the quantity of iodide is increased, since its vapor pressure is limited, an excess of iodide is not vaporized, and thus no iodide pool is formed on the inner surface of the closed glass ball. Such an iodide pool is yellow, and therefore it acts as a color filter, thus causing color irregularity. In addition, an iodide pool scatters light rays from the arc. Hence, when such an arc tube is employed for a headlamp, the iodide pool will cause the latter to emit a glare-causing beam. In the case where the quantity (density) of metal iodide is small, the light output is liable to fluctuate. Hence, it can be understood that, in order to obtain a desirable color temperature (4,000° to 4,500° K.), the density of the metal iodide should be $6\times10^{-3}$ to $12\times10^{-3}$ mg/μl.

Figure 3:
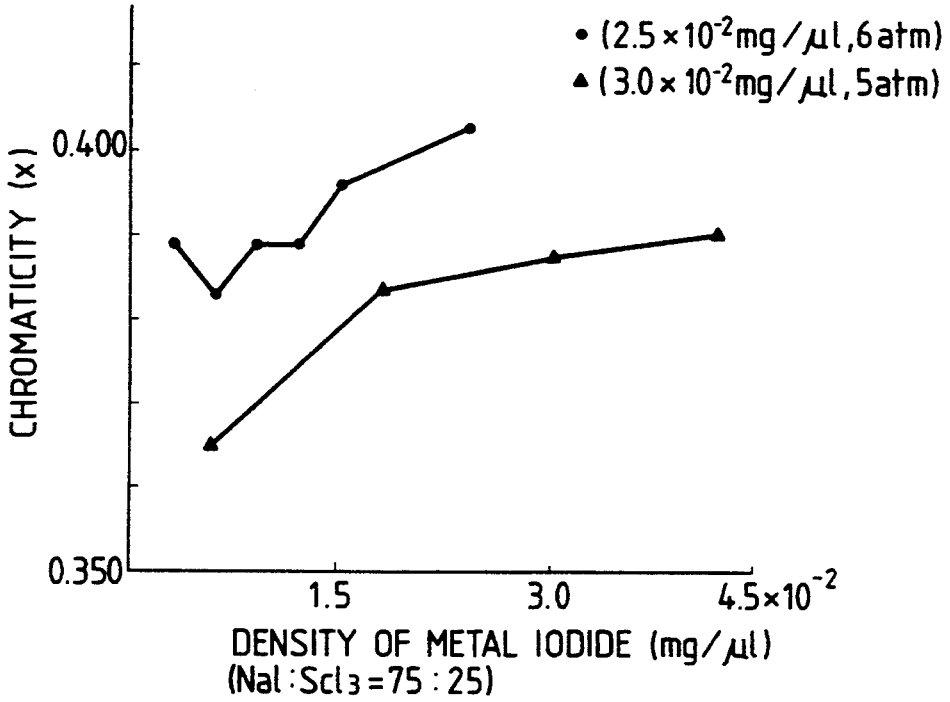
FIG. 3 is a graphical representation relationships between the density of metal iodide in the closed glass ball and chromaticity (x)
Figure 4:
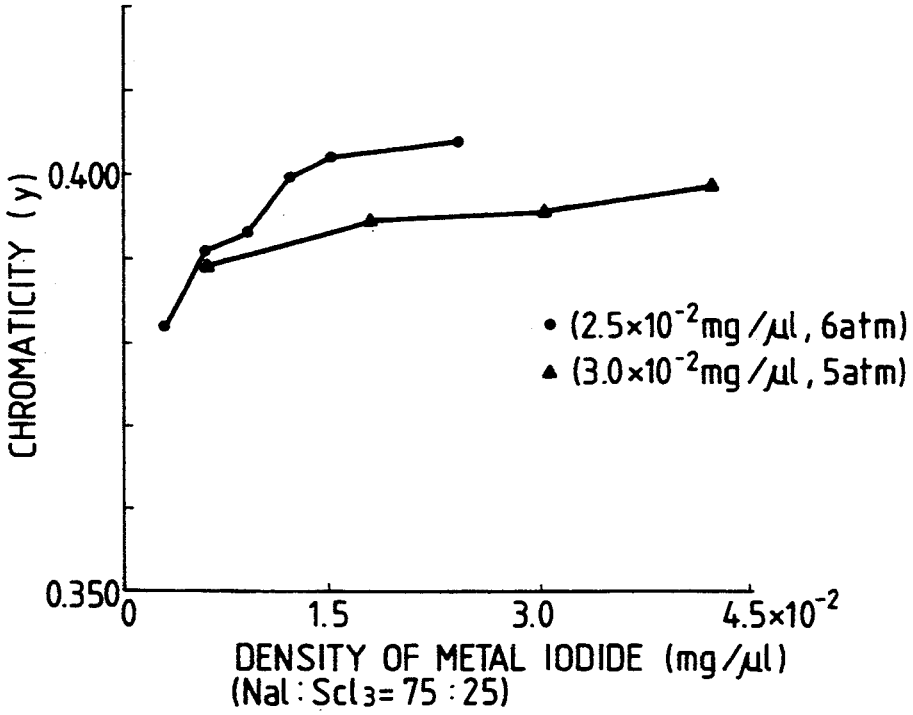
FIG. 4 is a graphical representation indicating relationships between the density of metal iodide in the closed glass ball and chromaticity (y)

FIG. 3 is a graphical representation indicating the relationships between the density (mg/μl) of metal iodide in the closed glass tube and the chromaticity (x). FIG. 4 is also a graphical representation indicating the relationship between the density (mg/μl) of metal iodide in the closed glass tube and the chromaticity (y). As is seen from those figures, in order for the output light of the arc tube to be substantially equal in chromaticity to natural sunlight, the chromaticity (x) should be 0.38 to 0.39 and the chromaticity (y) should be 0.39 to 0.40. For this purpose, the metal iodide should have a density of $6\times10^{-3}$ to $12\times10^{-3}$ mg/μl.

Figure 8:
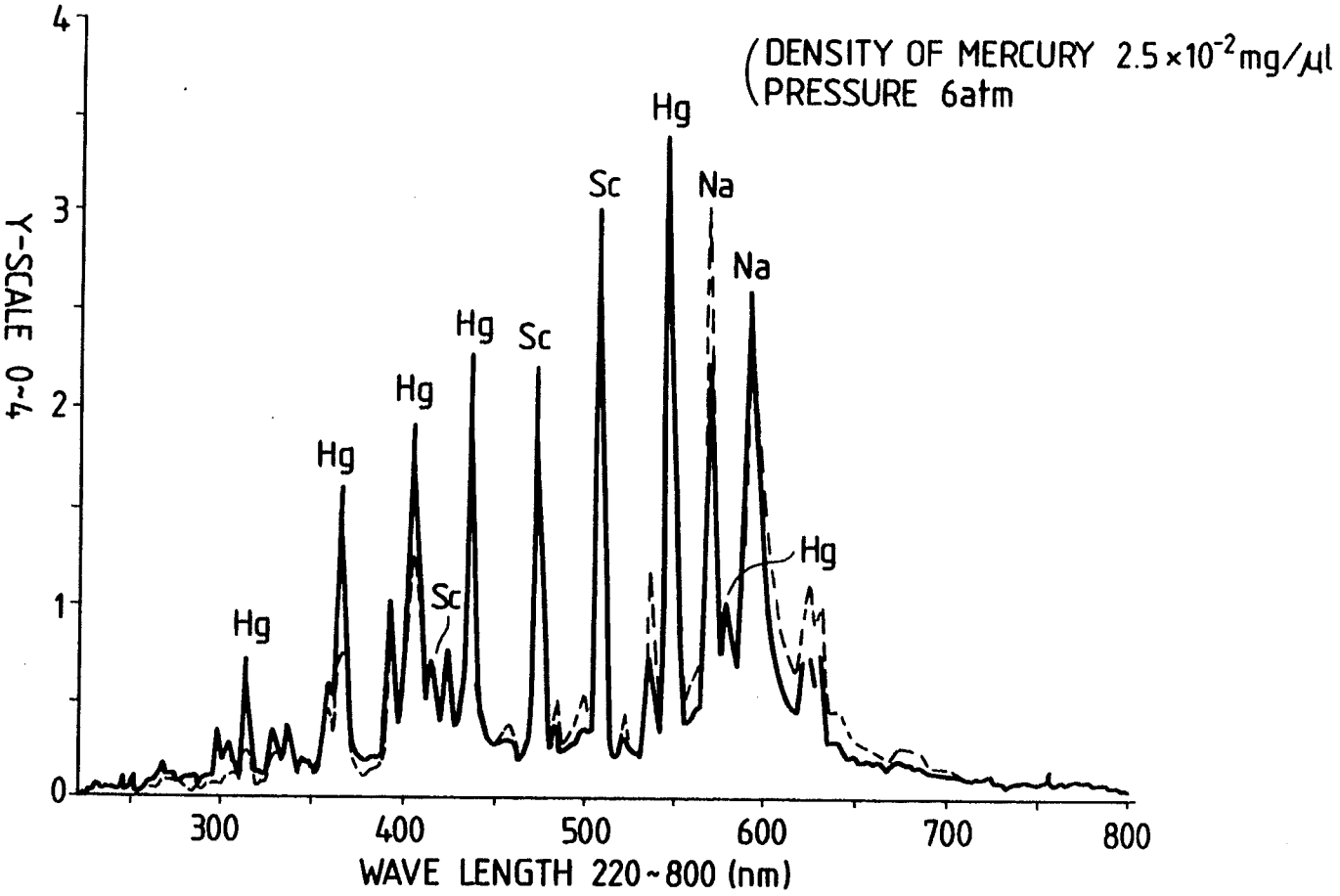
FIG. 8 is a graphical representation indicating the spectral distribution of light outputted by the closed glass ball when the metal iodide therein is varied in density.

FIG. 8 is a graphical representation indicating the spectral distribution of light outputted by the arc tube when the density of metal iodide in the closed glass ball is varied. In the case where the density of metal iodide is $24\times10^{-3}$ mg/μl (indicated by the broken lines), compared with the case where it is $6\times10^{-3}$ mg/μl (indicated by the solid lines), the peak of mercury is low, the peaks of Sc and Na existing as the metal iodide are high, and the energy of the background is high. This is due to the fact that as the density of metal iodide increases, the thermal balance in the closed glass ball is changed, so that the light emitting rate of the metal iodide becomes larger than that of the mercury. As a result, as shown in FIGS. 3 and 4, the chromaticity (x) and the chromaticity (y) become large (the color temperature being decreased as shown in FIG. 2), and the luminous flux is increased as shown in FIG. 1.

Figure 5:
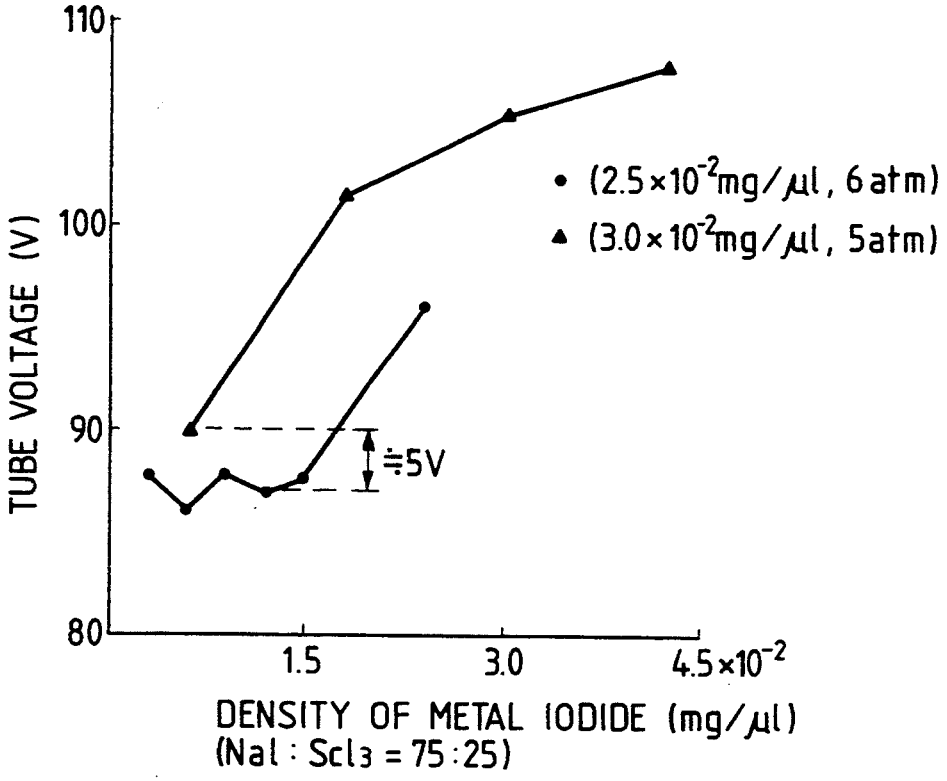
FIG. 5 is a graphical representation indicating relationships between the density of metal iodide in the closed glass ball and tube voltage.

FIG. 5 is a graphical representation indicating the relationships between the density of metal iodide in the closed glass ball and the tube voltage. As described above, it is preferable that the tube voltage be in a range of 80 to 90 V. For this purpose, the density of metal iodide in the closed glass ball should be $6\times10^{-3}$ to $12\times10^{-3}$ mg/μl.

On the other hand, the inventors have established the following equation:

$$V=87.3\ \rho^{0.431}d^{0.926}p^{0.136}$$

where V is the tube voltage, $\rho$ is the mercury density (mg/$\mu$l), d is the electrode gap distance (mm), and P is the Xe gas pressure (atm). It has been confirmed from this equation that, in order to set the tube pressure to 80 to 90 V, the charged Xe gas pressure should be should be 3 to 6 arm.

Figure 6:
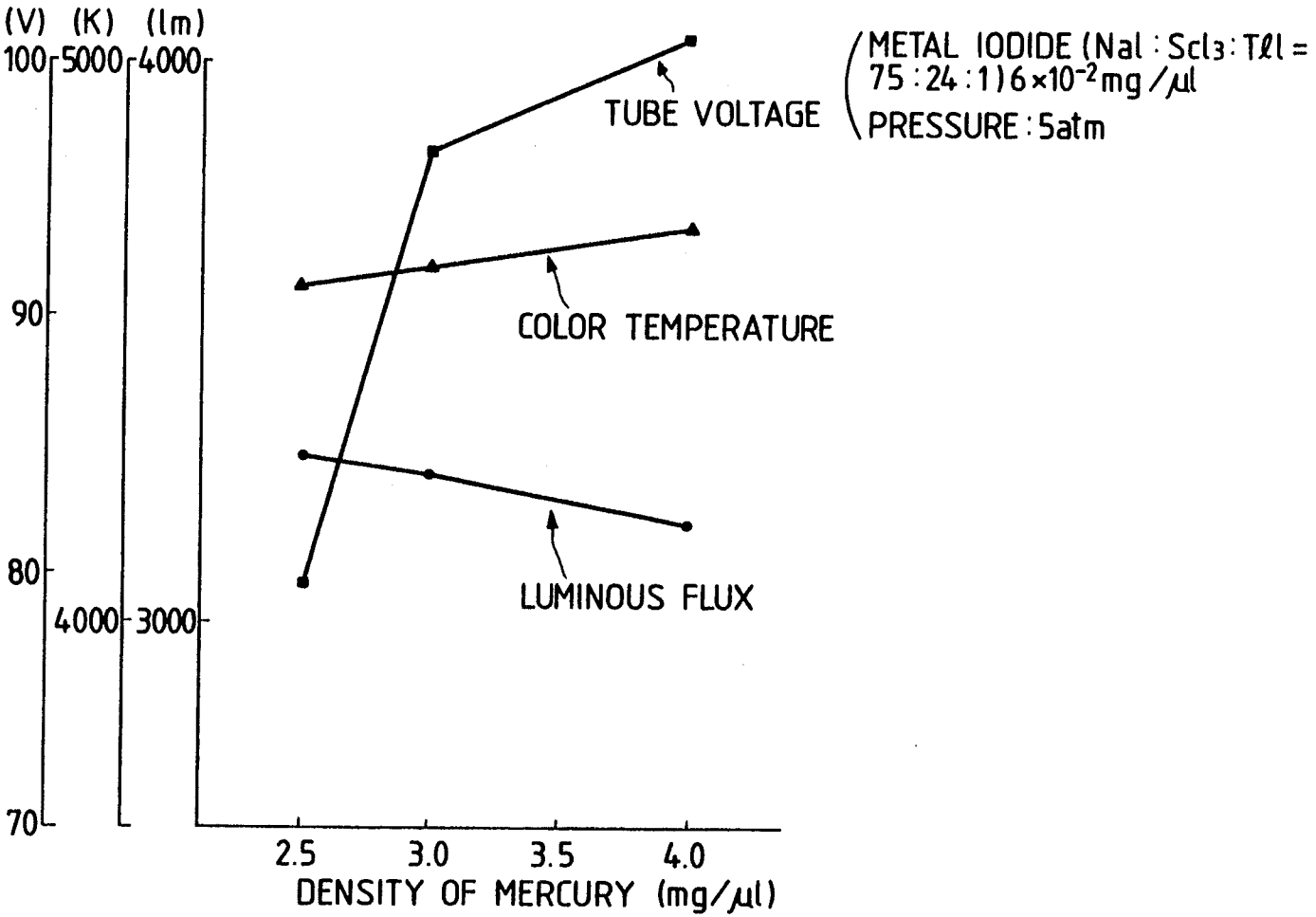
FIG. 6 is a graphical representation indicating tube voltage, color temperature, and luminous flux with respect to mercury density.

FIG. 6 is a graphical representation indicating mercury density and tube voltage, color temperature, and luminous flux with respect to mercury density. In this case, the metal iodide in the closed glass ball contains sodium iodide, scandium iodide and thallium iodide. As is seen from FIG. 6, the tube voltage and the color temperature are proportional to mercury density, and the luminous flux is inversely proportional to mercury density. In order to set the tube voltage to 80 to 90 V, the color temperature to 4,000° to 4,500° K., and the luminous flux to 3,200 to 3,500 lumen, the mercury density should be set to $2\times10^{-2}$ to $4\times10^{-2}$ mg/$\mu$l.

Figure 7:
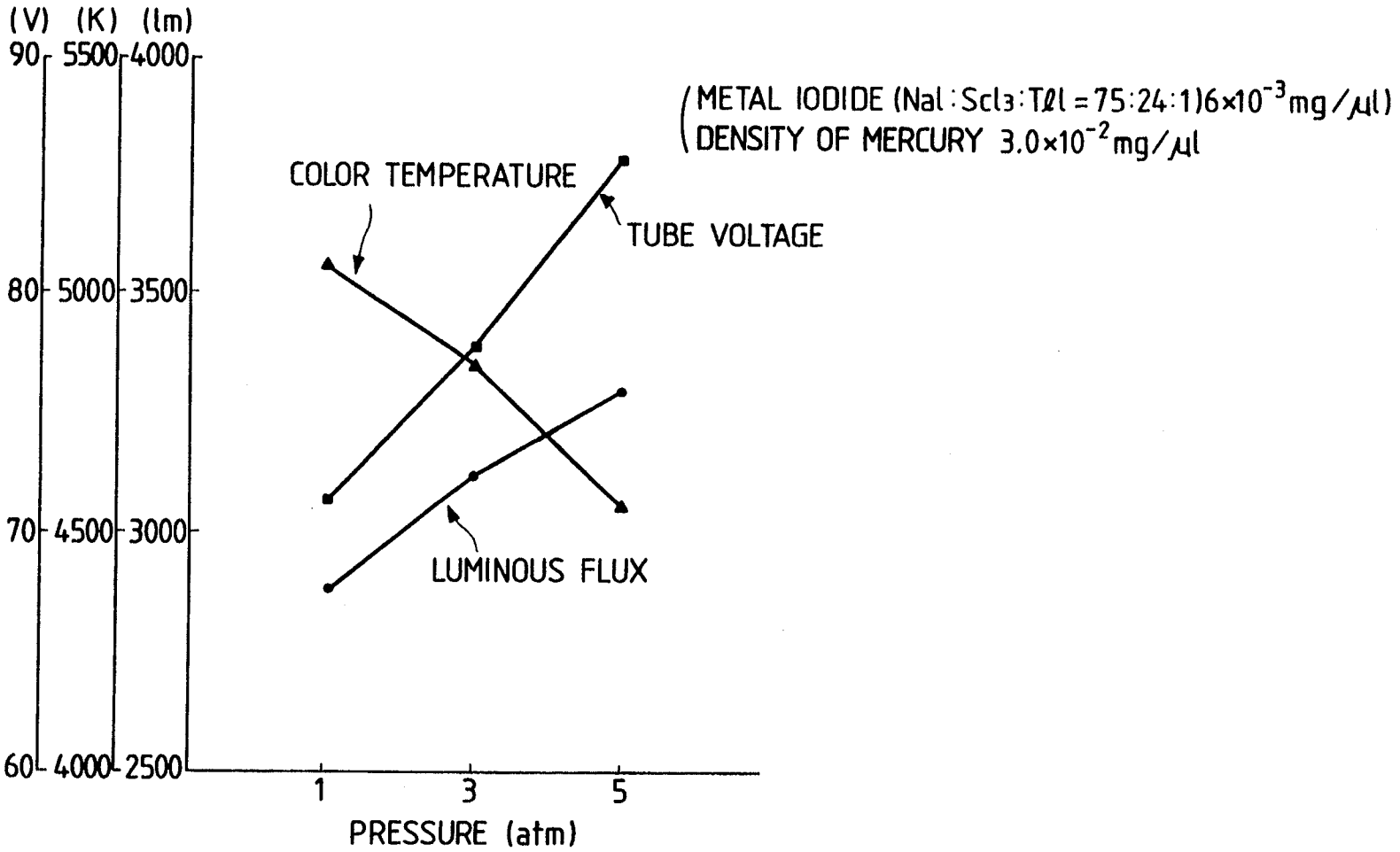
FIG. 7 is a graphical representation indicating tube voltage, color temperature and luminous flux with respect to charged Xe gas pressure.

FIG. 7 is a graphical representation indicating tube pressure, color temperature, and luminous flux with respect to charged Xe gas pressure. As in the case of FIG. 11, thallium iodide is added in the metal iodide. As is apparent from FIG. 7, the tube voltage is proportional to the charged Xe gas pressure, and the color temperature and the luminous flux are inversely proportional to the charged Xe gas pressure. In order to set the tube voltage to 80 to 90 V, the color temperature to 4,000° to 4,500° K., and the luminous flux to 3,200 to 3,500 lumen, the charged Xe gas pressure should be set to 3 to 6 atm.

Figure 9:
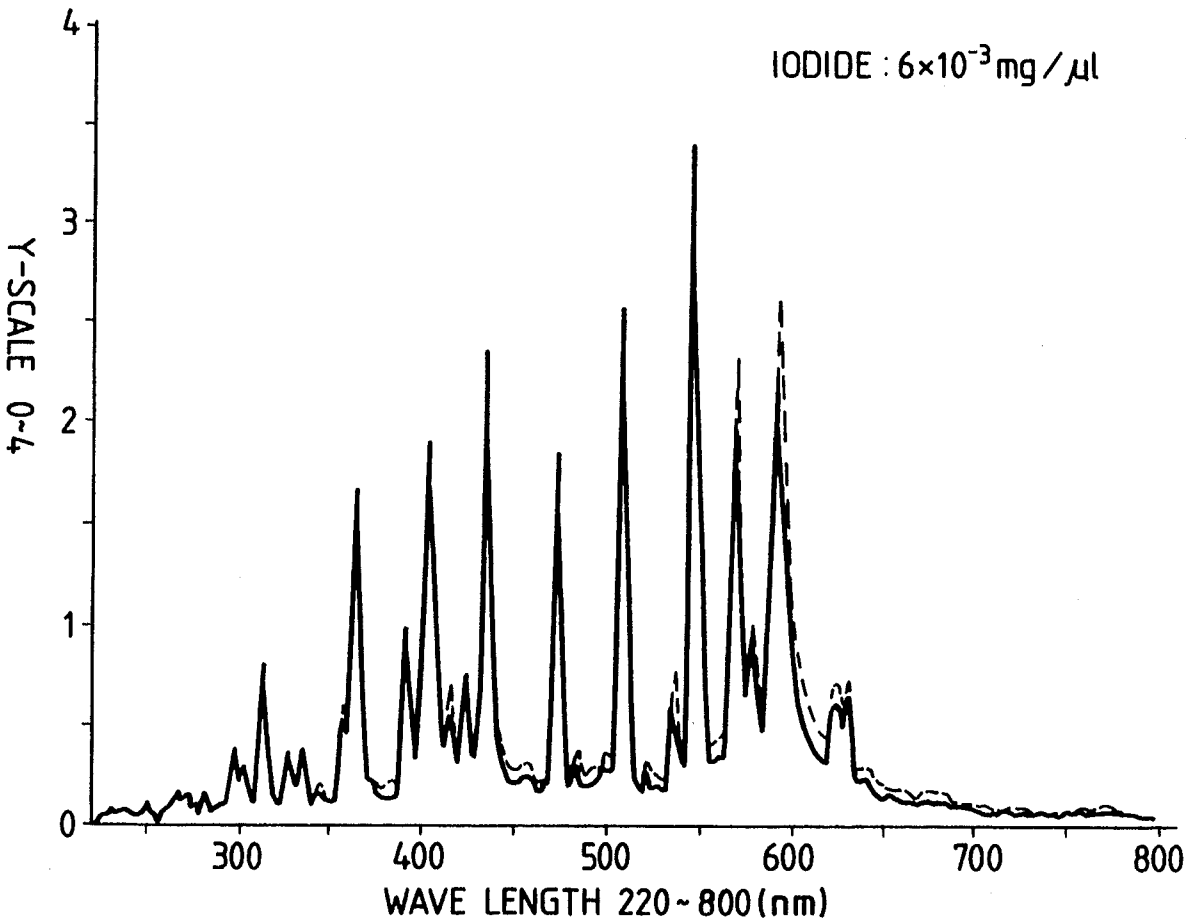
FIG. 9 is a graphical representation indicating the spectral distribution of light outputted by the closed glass ball when the mercury density and the charged Xe gas pressure are changed.

FIG. 9 is a graphical representation indicating the spectral distribution of light outputted by the arc tube when the mercury density and the charged Xe gas pressure are changed. As is seen from FIG. 9, when the mercury density is decreased from $3\times10^{-2}$ mg/$\mu$l to $2.5\times10^{-2}$ mg/$\mu$l, and the charged Xe gas pressure is increased from 5 atm to 6 atm, the peak of mercury is decreased, the peaks of Sc and Na are increased, and the energy of the background is increased. This is due to the fact that, similar to the case where the density of metal iodide increases, the thermal balance in the closed glass ball is changed, so that the light emitting rate of the metal iodide becomes larger than that of the mercury. As a result, as shown in FIG. 6, the chromaticity (x) and the chromaticity (y) become large (the color temperature being decreased), and the luminous flux is increased.

As is apparent from the above description, in the manufacture of an arc tube for a discharge lamp unit according to the invention, desirable standard ranges are established for the densities of the mercury and the metal iodide filled in the closed glass tube of the arc tube and for the charged Xe gas pressure. Therefore, by determining the mercury density, the metal iodide density, and the charged Xe gas pressure according to the ranges established in accordance with the invention, arc tubes can be readily manufactured which emit a light beam under a suitable tube voltage which, being substantially constant in luminous flux, chromaticity and color temperature, provides good illumination of the area in front of the vehicle but does not dazzle the driver on an oncoming vehicle.

What is claimed is:

1. In an arc tube for a discharge lamp unit comprising a closed glass ball in which electrodes confront one another and which is sealingly charged with light emitting materials, including mercury and a metal iodide of NaI and $ScI_3$ groups together with Xe inert gas, the improvement comprising:

said closed glass ball having a volume in a range of 20 to 50 $\mu$l, said mercury in said closed glass ball having a density in a range of $2\times10^{-2}$ to $4\times10^{-2}$ mg/$\mu$l, said metal iodide in said closed glass ball having a density in a range of $6\times10^{-3}$ to $12\times10^{-3}$ mg/$\mu$l, and a charged gas pressure of said Xe inert gas being in a range of 3 to 6 atm.

* * * * *